US005094633A

United States Patent [19]

Arai et al.

[11] Patent Number: 5,094,633

[45] Date of Patent: Mar. 10, 1992

[54] ELECTRICAL CONTACT TERMINAL AND METHOD OF MAKING SAME

[75] Inventors: Tatsuya Arai; Hiroshi Ohkawa, both of Tokyo, Japan

[73] Assignee: Hirose Electric Co., Ltd., Tokyo, Japan

[21] Appl. No.: 705,600

[22] Filed: May 24, 1991

[30] Foreign Application Priority Data

Jul. 26, 1990 [JP] Japan ..... 2-196339

[51] Int. Cl.[5] ..... H01R 13/42

[52] U.S. Cl. ..... 439/751; 439/873; 29/845; 29/882

[58] Field of Search ..... 439/741, 751, 870, 873; 29/844, 845, 874, 882

[56] References Cited

U.S. PATENT DOCUMENTS

| | | | |
|---|---|---|---|
| 4,415,220 | 11/1983 | Kant | 439/751 |
| 4,586,778 | 5/1986 | Walter et al. | 439/751 |
| 4,733,465 | 3/1988 | Tanaka | 439/751 |
| 4,746,301 | 5/1988 | Key | 439/751 |
| 4,907,988 | 3/1990 | Tilse | 439/751 |

*Primary Examiner*—David L. Pirlot
*Attorney, Agent, or Firm*—Kanesaka & Takeuchi

[57] ABSTRACT

An electrical contact terminal which includes a terminal portion (1); an insertion portion (2); and a press-fit portion (4) provided between the terminal portion and the insertion portion and having a pair of abutment portions (5, 6) and a bridge portion (7) between the abutment portions to form an S-shaped cross section, the bridge portion having a pair of expanded portions (11, 12) connected to the abutment portions with a pair of tie portions (8, 10) and interconnected with a central tie portion (9), with the tie portions each being defined by a recess (13, 15) and a concave surface (14, 16) and the central tie portion being defined by the recesses, the tie portions having substantially the same cross sections having equal yielding deformations, the abutment portions, the expanded portions, and the central tie portion being made symmetrical about a center O of the bridge portion, a distance L between the abutment portions and a distance L' between the expanded portions when the press-fit portion is not press fitted in a through hole being made greater than and smaller than a diameter D of the through hole, respectively, and the abutment portions having an abutment surface (5a, 6a) with a radius of curvature which is equal to that of the through hole 20.

2 Claims, 7 Drawing Sheets

ELECTRICAL CONTACT TERMINAL AND METHOD OF MAKING SAME

BACKGROUND OF THE INVENTION

1. Field of the Invention

The present invention relates to press-fit electrical contact terminals and methods of making the same and, more particularly, to improvements in the through-hole press-fit portion of such an electrical contact for securing the electrical terminal in the through hole of a circuit board and a method of making the same.

2. Description of the Prior Art

FIG. 18 shows, in cross section, the through-hole press-fit portion 64 (hereinafter "press-fit portion") of a conventional press-fit electrical contact terminal which consists of a pair of contact portions 62 and 62' and a bridge portion 63 for connecting the contact portions 62 and 62' to form a N-shaped cross section. The bridge portion 63 is formed with opposed V-shaped notches 60 and 61 having a height or depth greater than a half of the height or thickness of the press-fit portion 64. The contact portion 62 or 62' has a pair of corners 64 and 65 or 66 and 67 abutting against the wall 68*a* of a through hole 68 as shown in FIG. 19.

When such an electrical terminal is press fitted in the through hole 68, the four corners 64–67 abut against the wall 68*a* of the through hole 68, and the bridge portion 63 is deformed to absorb the compression force produced by the abutment.

However, since the depth of the notches 60 and 61 is greater than a half of the thickness of the press-fit portion, not only a large amount of labor is necessary to make the notches but also it has been impossible to make subminiature terminals useful for through holes having a diameter of 0.6 mm or less because of lack of the strength in a coining process.

In addition, the compression force due to the abutment against the through hole 68 is absorbed by the deformation of the bridge portion 63 so that the deformation concentrates on the bridge portion 63, limiting the flexibility. As a result, there is a demand for contact terminals useful for subminiature through holes.

Moreover, the deformation and the compression force change abruptly so that the cross sectional area of a through-hole press-fit portion hardly change, limiting the range in diameter of useful through holes and requiring a large press-fit force.

SUMMARY OF THE INVENTION

Accordingly, it is an object of the invention to provide a press-fit electrical contact terminal which assures firm contact.

It is another object of the invention to provide a press-fit electrical contact terminal having a through-hole press-fit portion which is so flexible that not only it is fitted in a broad range of through holes including the subminiature through holes but also the abutment positions on the through-hole wall remain in place.

It is still another object of the invention to provide a press-fit electrical contact terminal with which the compression force against the through hole wall is distributed evenly to prevent the through hole from being damaged or the circuit conductor from been broken.

It is yet another object of the invention to provide a simple and efficient method of making such an electrical contact terminal as described above.

It is another object of the invention to provide a method of making such an electrical contact as described above in which coining is provided without difficulty, making it possible to make subminiature terminals.

According to one aspect of the invention there is provided an electrical contact terminal which includes a terminal portion; an insertion portion; and a press-fit portion provided between the terminal portion and the insertion portion and having a pair of abutment portions and a bridge portion between the abutment portions to form an S-shaped cross section, the bridge portion having a pair of expanded portions connected to the abutment portions with a pair of tie portions and interconnected with a central tie portion, with the tie portions each being defined by a recess and a concave surface and the central tie portion being defined by the recesses, the tie portions having substantially the same cross sections having equal yielding deformations, the abutment portions, the expanded portions, and the central tie portion being made symmetrical about a center O of the bridge portion, a distance L between the abutment portions and a distance L' between the expanded portions when the press-fit portion is not press fitted in a through hole being made greater than and smaller than a diameter D of the through hole, respectively, and the abutment portions having an abutment surface with a radius of curvature which is equal to that of the through hole.

When it is inserted into a through hole, the press-fit is compressed with the abutment surfaces abutting on the wall of the through hole, with the bridge portion undergoing elastic deformation. Since the tie portions have substantially the same cross sections having equal yielding deformations, the deformation and the compression force change smoothly. This elastic deformation stores the mechanical energy producing the necessary contact pressure on the abutment surfaces thereby assuring a firm contact. In addition, the amount of change in the press-fit portion is sufficiently large to provide a broad range in diameter of useful through holes including subminiature through holes.

Since the central tie portion is twisted about the center O, with the abutment portions linearly moving toward the center O, the reactive force due to the compression deformation acts on the wall of the through hole thereby preventing changes of the abutment positions and thus abrupt rises in the compression force.

Moreover, the abutment surfaces have a radius of curvature which is equal to that of the through hole so that the compression force on the through hole is distributed evenly thereby preventing damage to the through hole or circuit conductor.

According to another aspect of the invention there is provided a method of making the above electrical contact terminal which comprises the steps of stamping a flat portion from a strip of sheet metal; coining the flat portion with a working surface for forming a recess, an expanded portion, and a concave surface, a recess forming portion being projected no more than a half of a thickness of the press-fit portion, cutting opposite ends of the coined flat portion with a pair of trimming punches; bending a pair of portions from the expanded portion to the abutment portion with a pair of bending punches; and pressing the abutment portions with a pair of surface punches to provide a pair of abutment surfaces having a radius of curvature which is equal to that of the through hole.

By this method, it is easy to make the above electrical contact terminal. Especially, there is provided the coining process with the coining mold with the working surface for forming the recess, the expanded portion, and the concave surface, the recess forming portion being made no more than a half of the thickness t of the press-fit portion, so that the punch strength for the coining process is increased, facilitating the coining process and the manufacture of subminiature terminals.

The above and other objects, features, and advantages of the invention will be more apparent from the following description when taken in conjunction with the accompanying drawings.

DESCRIPTION OF THE PREFERRED EMBODIMENT

In FIGS. 1-4, an electrical contact terminal includes a terminal portion 1, an insertion portion 2, a connector side press-fit portion 3, and a through-hole press-fit portion (hereinafter "press-fit portion) 4.

Figure 1:
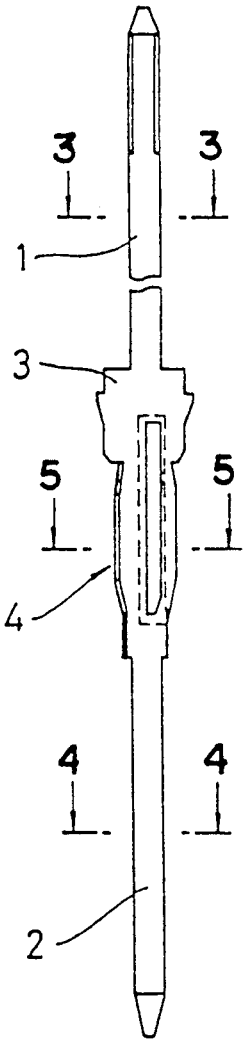
FIG. 1 is a front elevational view of an electrical contact terminal according to an embodiment of the invention.
Figure 2:
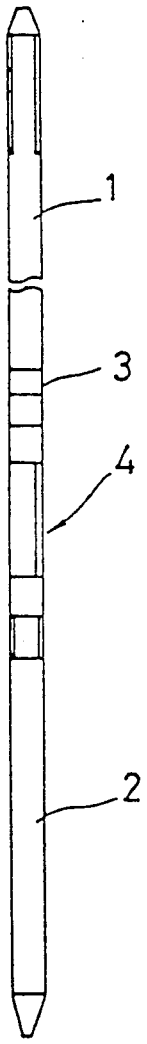
FIG. 2 is a side elevational view thereof.
Figure 3:
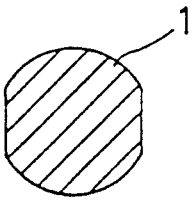
FIG. 3 is a cross sectional view taken along the line 3—3 of FIG. 1.
Figure 4:
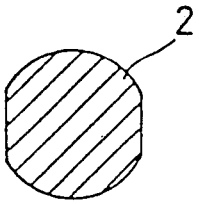
FIG. 4 is a cross sectional view taken along the line 4—4 of FIG. 1.
Figure 5:
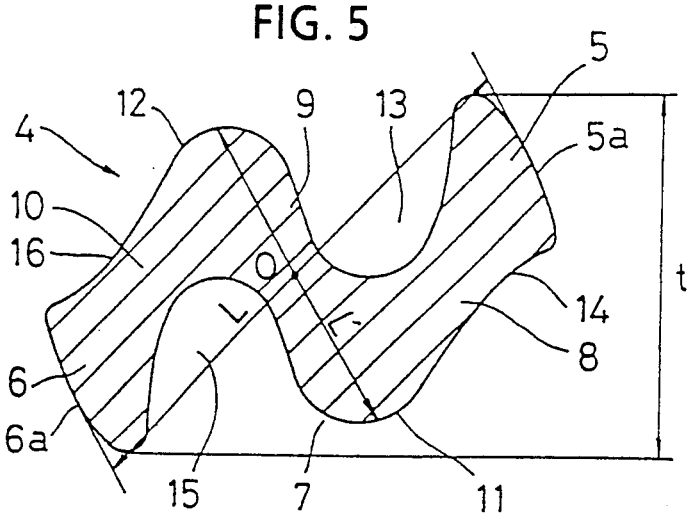
FIG. 5 is a cross sectional view taken along the line 5—5 of FIG. 1.

In FIG. 5, the press-fit portion 4 having a substantially S-shaped cross section has a pair of abutment portions 5 and 6 and a bridge portion 7 for connecting the abutment portions 5 and 6. The abutment portions 5 and 6 are made symmetrical about the center 0 of the bridge portion 7. The bridge portion 7 has a pair of tie portions 8 and 10, a central tie portion 9, and a pair of expanded portions 11 and 12 between the central tie portion 9 and the respective tie portions 8 and 10. The expanded portions 11 and 12 are made symmetrical about the center O of the central tie portion 9.

The tie portions 8, 9, and 10 are defined by a recess 13 and a concave surface 14, recesses 13 and 15, and the recess 15 and a concave surface 16, respectively. The depth of the recesses 13 and 15 is smaller than a half of the thickness t of the press-fit portion. The tie portions 8, 9, and 10 have substantially equal yielding sections which undergo substantially equal yielding deformations. The abutment surfaces **5*a* and 6*a* of the abutment portions 5 and 6 have a radius of curvature which is equal to that of the through hole 20. The distance L between the abutment surfaces 5*a* and 6*a* when the press-fit portion 4 is not compressed is greater than the diameter D of the through hole 20 while the distance L' between the expanded portions 11 and 12** is smaller than the diameter D of the through hole.

Figure 6:
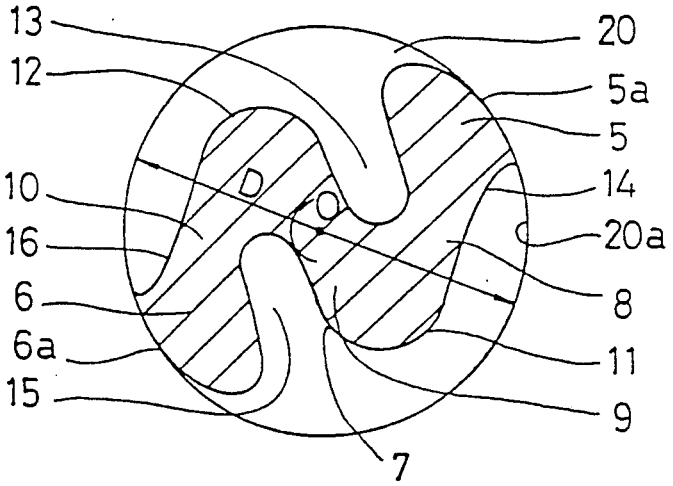
FIG. 6 is a cross sectional view of the press-fit portion when the electrical contact terminal is press fitted into a large through hole.

In FIG. 6, the press-fit portion 4 of the electrical contact terminal is press fitted into a large through hole 20 so that it is compressed with the abutment surfaces **5*a* and 6*a* of the abutment portions 5 and 6 pressed against the wall 20*a* of the through hole 20. That is, the bridge portion 7 between the abutment portions 5 and 6 is deformed. Since the tie portions 8, 9, and 10 have substantially the same cross sections having equal yielding deformations, the deformation and the compression force change smoothly. This elastic deformation absorbs the mechanical energy, producing the necessary contact pressure on the abutment surfaces 5*a* and 6*a*. It is noted that the expanded portions 11 and 12 do not contact the wall 20*a* of the through hole 20**.

Since the tie portions 8 and 10 are made symmetrical about the center O of the central tie portion 9 and defined by the recess 13 and the concave surface 14, and the recess 15 and the concave surface 16, respectively, the central tie portion 9 is twisted about the center O in the direction of an arrow as shown in FIG. 6 while the abutment portions 5 and 6 linearly move toward the center O. The reactive force to this compression deformation acts on the wall **20*a* of the through hole 20 so that the abutment positions of the abutment portions 5 and 6 on the wall 20*a* of the through hole 20** remain the same, thereby preventing a sharp increase of the compression force.

The abutment surfaces **5*a* and 6*a* of the abutment portions 5 and 6 have a radius of curvature which is equal to that of the wall 20*a* of the through hole 20 so that the compression force on the wall 20*a* of the through hole 20 is distributed evenly to prevent the through hole 20** or the circuit conductor from being broken.

Since the tie portions 8, 9, and 10 have substantially the same cross sections having equal yielding deformations so that the deformation and the compression force change smoothly. Consequently, the amount of change in the press-fit portion 4 upon insertion into the through hole 20 is sufficiently large to provide a broad range of useful diameters for the through holes including subminiature through holes 20.

Figure 7:
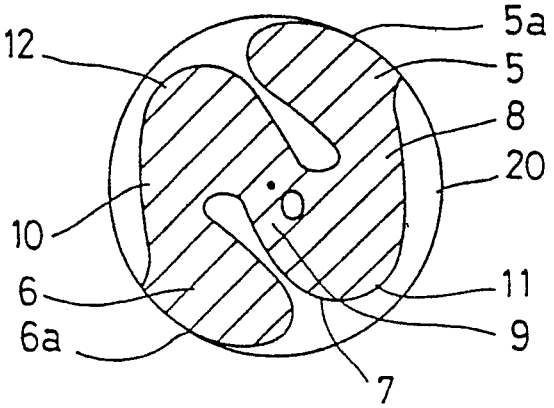
FIG. 7 is a cross sectional view of the press-fit portion when the electrical contact terminal is press fitted into a small through hole.

The press-fit portion 4 of an electrical contact terminal press fitted in a subminiature through hole 20 is shown in FIG. 7. The method of making the electrical contact terminal will now be described below.

Figure 8:
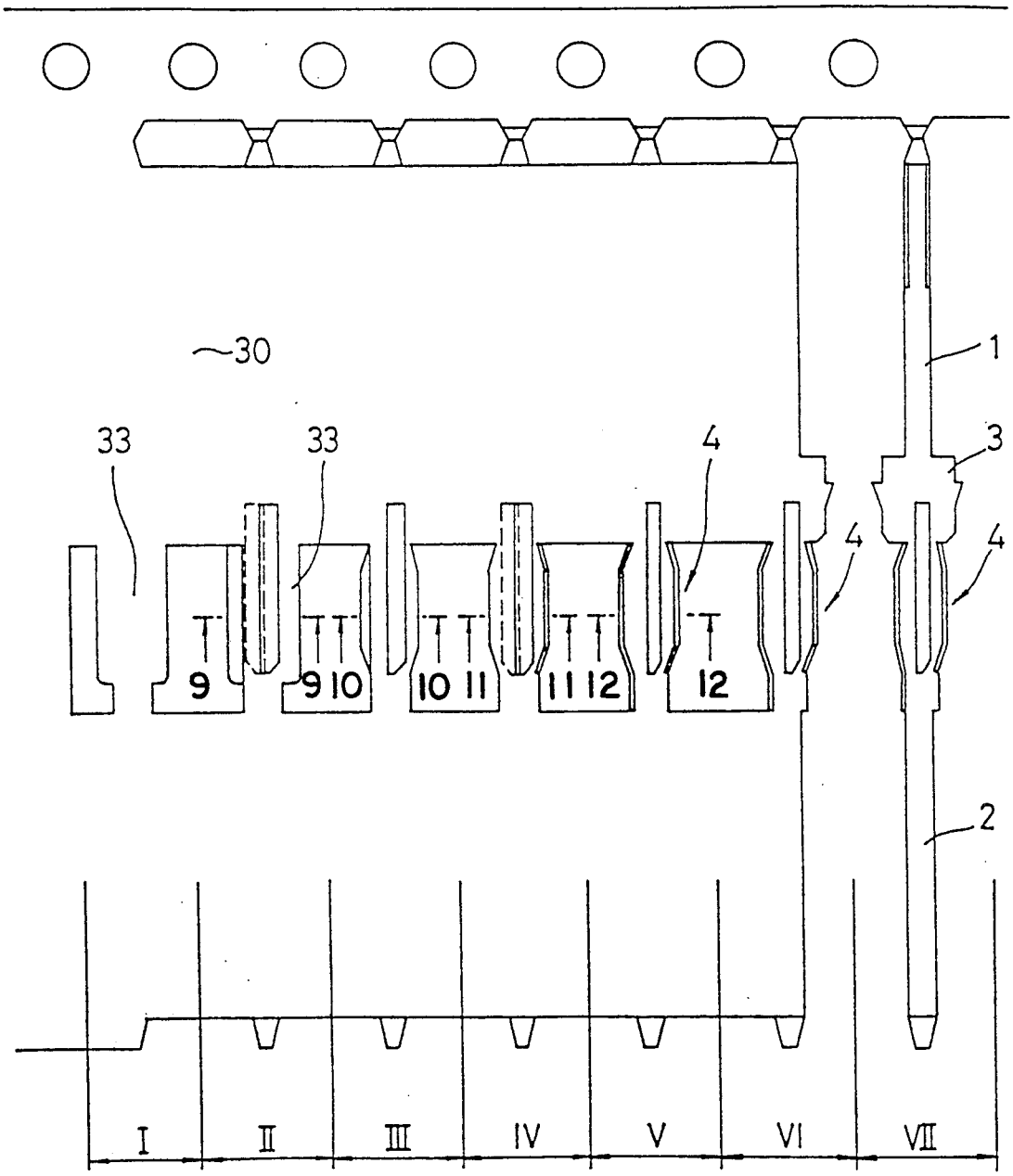
FIG. 8 is a top plan view of a strip of sheet metal useful for explaining how to make the electrical contact terminal.

As FIG. 8 shows, the electrical contact terminal is made through the following seven steps: the first stamping process I, the coining process II, the second stamping process III, the bending process IV, the circumferential surface forming process V, the terminal side stamping process VI, and the finishing process VII. Of these steps, the first stamping process I through the circumferential surface forming process V constitute a press-fit portion forming process.

Figure 13:
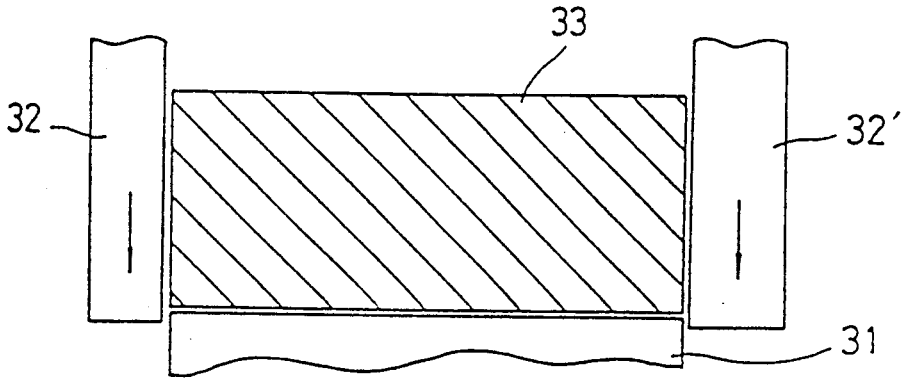
FIG. 13 is a cross sectional view of the press-fit portion of an electrical contact terminal useful for explaining the first stamping process I.

In the first stamping process I, a strip of sheet metal 30 is stamped in a press. As FIG. 13 shows, a pair of press dies 32 and 32' are moved downwardly pass the sheet metal 30 placed on a die 31 to form a press-fit flat portion 33.

Figure 14:
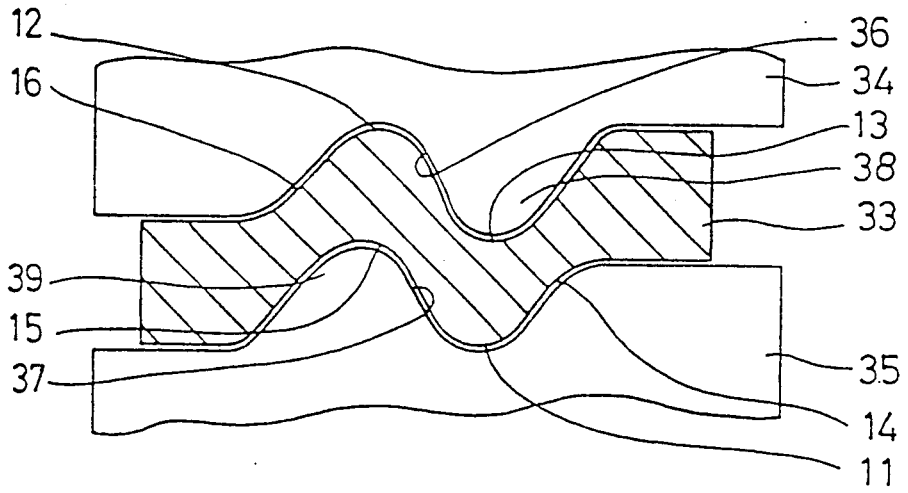
FIG. 14 is a cross sectional view of the press-fit portion useful for explaining the coining process II.

In the coining process II, as FIG. 14 shows, the flat portion 33 is coined between a coining punch 34 and a coining die 35. The coining punch 34 has a working surface 36 for forming the recess 13, the expanded portion 12, and the concave surface 16. The coining die 35 has a working surface 37 for forming the recess 15, the expanded portion 11, and the concave surface 14. The height of the recess forming portions 38 and 39 of the working surface 36 and 37 is made smaller than a half of the thickness t of the press-fit portion 4 to facilitate the coining process. With the coining punch 34 and the coining die 35, the flat portion 33 is provided with the recess 13 and 15, the expanded portions 12 and 11, and the concave surfaces 16 and 14, respectively, forming a coined portion 33.

Figure 15:
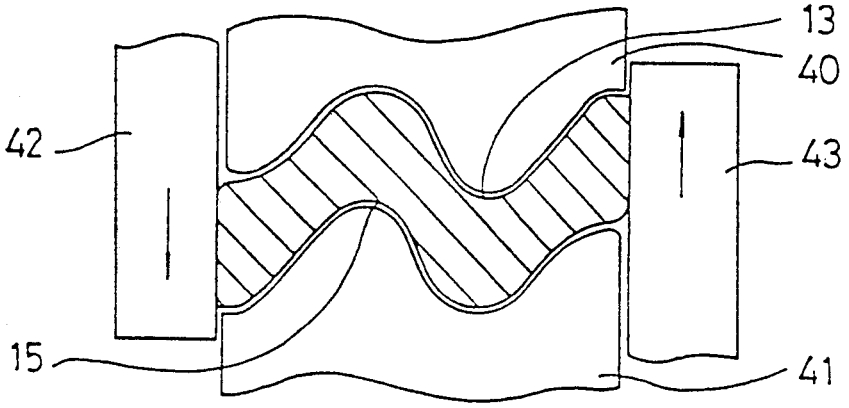
FIG. 15 is a cross sectional view thereof useful for explaining the second stamping process III.

As FIG. 15 shows, the second stamping process III is made by moving a pair of trimming punches 42 and 43 in opposite directions as indicated by arrows, with the coined portion 33 placed between a pair of guide members 40 and 41.

Figure 16:
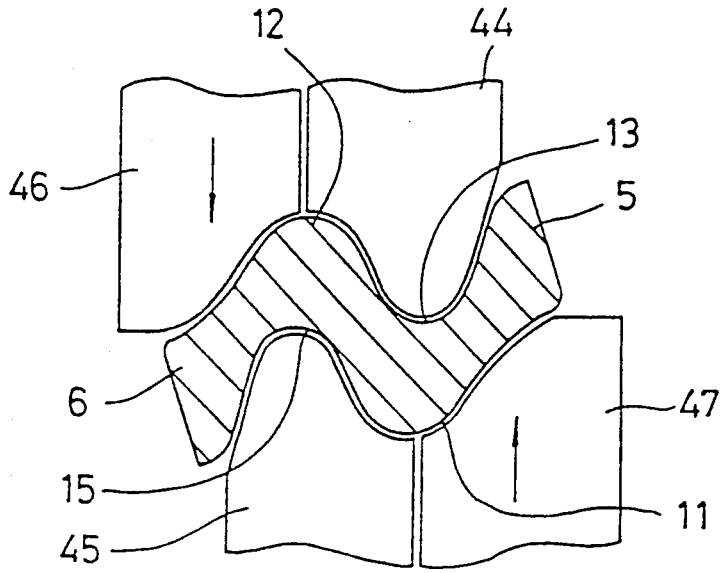
FIG. 16 is a cross sectional view thereof useful for explaining the bending process IV.

In the bending process IV, as FIG. 16 shows, the portions between the expanded portion 12 and the abutment portion 6, and the expanded portion 11 and the abutment portion 5 are bent with a pair of bending punches 46 and 47, respectively, with a pair of guide members 44 and 45 placed in the recesses 13 and 15 of the press-fit coined portion 33.

Figure 17:
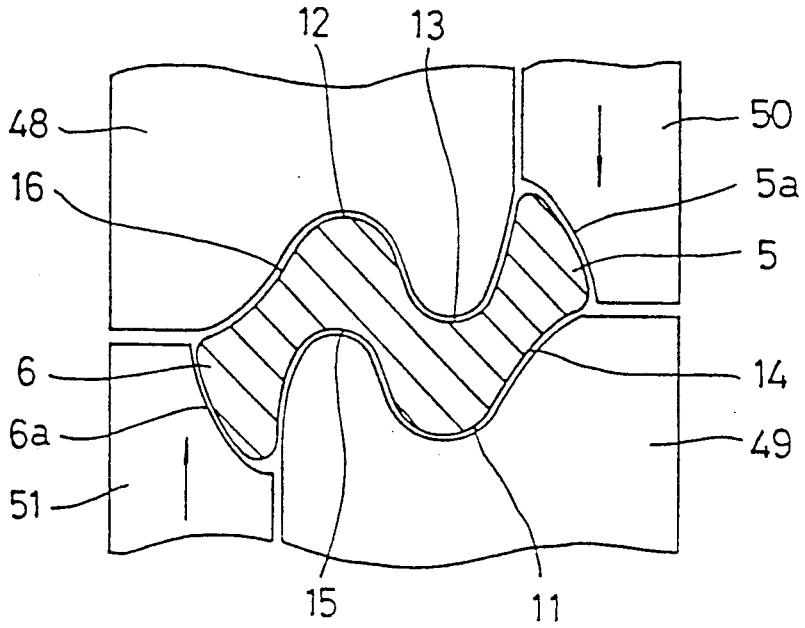
FIG. 17 is a cross sectional view thereof useful for explaining the circumferential surface forming process V.
Figure 18:
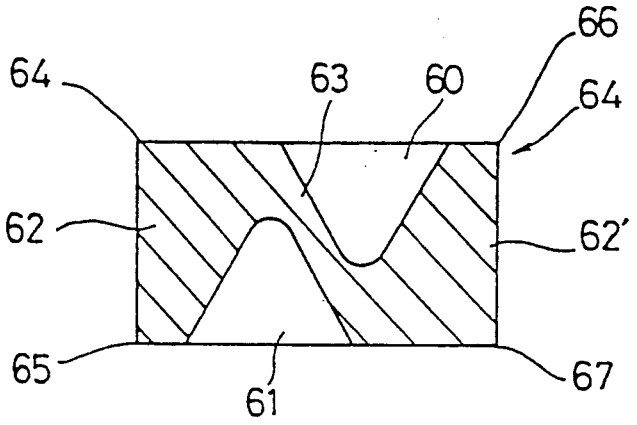
FIG. 18 PRIOR ART
FIG. 18 is a cross sectional view of the through-hole press-fit portion of a conventional electrical contact terminal.
Figure 19:
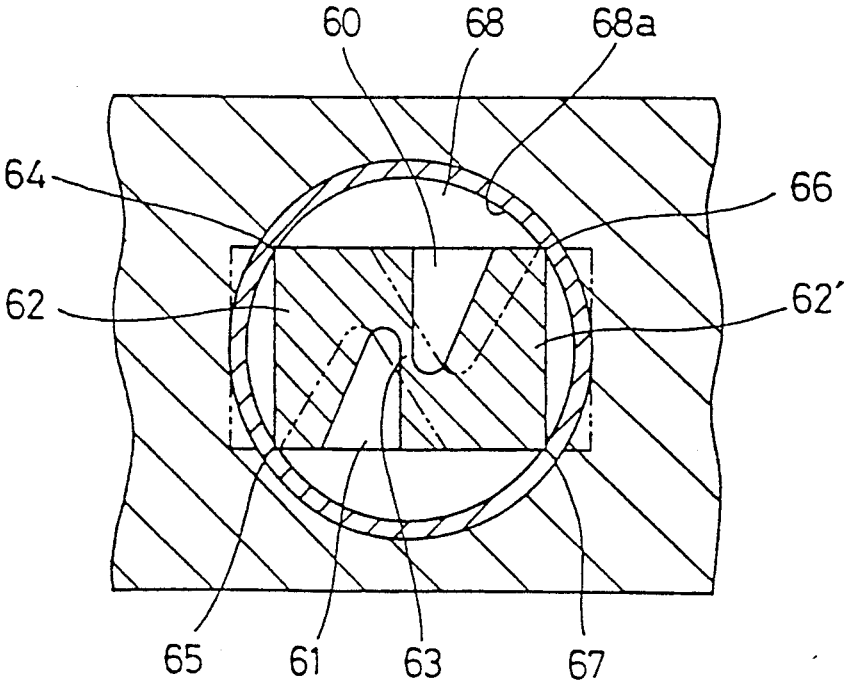
FIG. 19 PRIOR ART
FIG. 19 is a cross sectional view thereof in a through hole.

In the circumferential surface forming process V, as FIG. 17 shows, while a pair of guide members 48 and 49 are placed on the press-fit bent portion 33 along the recess 13, the expanded 12, and the concave surface 16 and along the recess 15, the expanded portion 11, and the concave surface 14, a pair of surface punches 50 and 51 are pressed against the abutment portions 5 and 6 to provide the abutment surfaces 5*a* and 6*a* with a radius of curvature which is equal to that of the wall 20*a* of the through hole 20.

In this way, the press-fit portion 4 is formed through the five process steps; namely, the first stamping process I, the coining process II, the second stamping process III, the bending process IV, and the circumferential surface forming process V. Then, the terminal side stamping process VI and the finishing process VII are applied to provide a finished electrical contact terminal.

Figure 9:
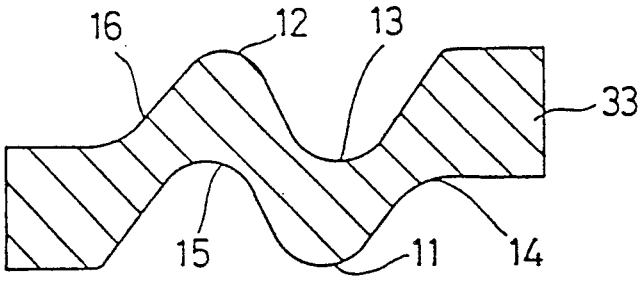
FIG. 9 is a cross sectional view taken along the line 9—9 of FIG. 8.
Figure 10:
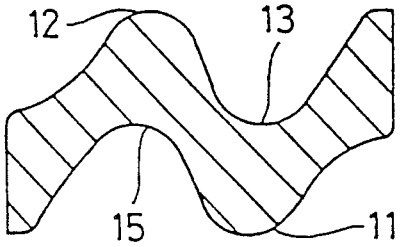
FIG. 10 is a cross sectional view taken along the line 10—10 of FIG. 8.
Figure 11:
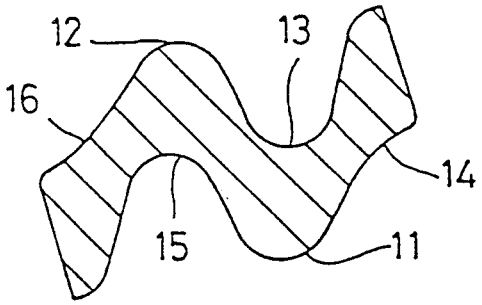
FIG. 11 is a cross sectional view taken along the line 11—11 of FIG. 8.
Figure 12:
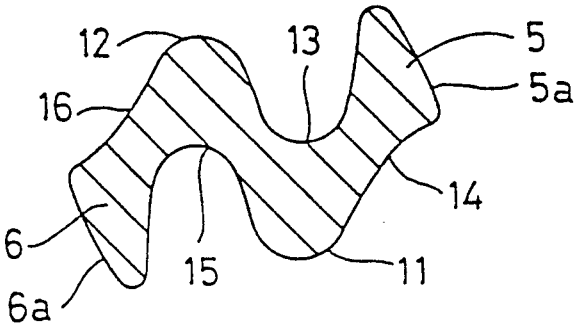
FIG. 12 is a cross sectional view taken along the line 12—12 of FIG. 8.

The cross section of the coined portion 33 is shown in FIG. 9. The cross section of the trimmed coined portion 33 is shown in FIG. 10. The cross section of the bent portion 33 is shown in FIG. 11. The cross section of the press-fit portion 4 with the circumferential surfaces shaped is shown in FIG. 12.

When the electrical contact terminal is press fitted into a through hole, the press-fit portion is compressed with abutment surfaces abutting on the wall of the through hole. The bridge portion between the abutment portions is resiliently deformed but the tie portions of the bridge portion have substantially the same cross sections having equal yielding deformations so that the deformation and the compression force change smoothly. This resilient deformation stores the mechanical energy causing the necessary contact pressure on the abutment surfaces, assuring a firm contact. Since the tie portions are substantially the same in cross section and the deformation and the compression force change smoothly, the amount of change in the press-fit portion is sufficiently large to provide a broad range of useful diameters for through holes including subminiature through holes.

When the electrical contact terminal is press fitted into a through hole, the central tie portion is twisted about the center O in the direction of the arrow in FIG. 6 while the abutment portions linearly move toward the center. The reactive force to this compression deformation acts on the wall of the through hole so that the abutment positions of the abutment portions on the wall of the through hole remain unchanged and preventing a steep rise of the compression force.

Since the abutment surfaces have a radius of curvature which is equal to that of the through hole, the compression force on the through hole is distributed evenly to prevent damage to the through hole or circuit conductor.

By the above method the electrical contact terminal is made without difficulty and with efficiency. Especially, the coining process is provided to form the recesses, the expanded portions, and the concave surfaces with the working surfaces. The height of the recess forming portions is made smaller than a half of the thickness of the press-fit portion so that the punching strength is increased, thereby facilitating the coining process and the manufacture of subminiature terminals.

I claim:

1. An electrical contact terminal comprising:

a terminal portion;

an insertion portion; and a press-fit portion provided between said terminal portion and said insertion portion and having a pair of abutment portions and a bridge portion between said abutment portions to form an S-shaped cross section, said bridge portion having a pair of expanded portions connected to said abutment portions with a pair of tie portions and interconnected with a central tie portion, said tie portions each being defined by a recess and a concave surface so that a cross section thereof is smaller than those of said expanded portions and said abutment portions, said central tie portion being defined by said recesses;

said tie portions having substantially the same cross sections so that they have substantially equally yielding deformations when said press-fit portion is fitted into a plated through hole, said abutment portions, said expanded portions, and said central tie portion being made symmetrical about a center of said ridge portion, a distance L between said abutment portions and a distance L' between said expanded portions when said press-fit portion is not press fitted in a through hole being made greater than and smaller than a diameter D of said through hole, respectively, and said abutment portions having an abutment surface with a radius of curvature which is substantially equal to that of said through hole.

2. A method of making an electrical contact terminal which includes a terminal portion; an insertion portion; and a press-fit portion provided between said terminal portion and said insertion portion and having a pair of abutment portions and a bridge portion between said abutment portions to form an S-shaped cross section, said bridge portion having a pair of expanded portions connected to said abutment portions with a pair of tie portions and interconnected with a central tie portion, with said tie portions each being defined by a recess and a concave surface and said central tie portion being defined by said recesses, said tie portions having substantially the same cross sections having equal yielding deformations, said abutment portions, said expanded portions, and said central tie portion being made symmetrical about a center of said bridge portion, a distance L between said expanded portions when said press-fit portion is not press fitted in a through hole, being made grater than and smaller than a diameter D of said through hole, respectively, and said abutment portions having an abutment surface with a radius of curvature which is substantially equal to that of said through hole, which comprises the steps of:

stamping a flat portion from a strip of sheet metal;

coining said flat portion with a working surface for forming a recess, an expanded portion, and a concave surface, a recess forming portion being projected no more than a half of a thickness of said press-fit portion, cutting opposite ends of said coined flat portion with a pair of trimming punches;

bending a pair of portions from said expanded portion to said abutment portion with a pair of bending punches; and pressing said abutment portions with a pair of surface punches to provide a pair of abutment surfaces having a radius of curvature which is equal to that of said through hole.

* * * * *